US011091348B2

(12) United States Patent
Gustafsson et al.

(10) Patent No.: US 11,091,348 B2
(45) Date of Patent: Aug. 17, 2021

(54) HOSE REEL AND METHOD FOR CONNECTING A HOSE TO THE HOSE REEL

(71) Applicant: CEJN AB, Skövde (SE)

(72) Inventors: Ove Gustafsson, Skövde (SE); Johan Olsson, Skövde (SE)

(73) Assignee: CEIN AB, Skövde (SE)

( * ) Notice: Subject to any disclaimer, the term of this patent is extended or adjusted under 35 U.S.C. 154(b) by 51 days.

(21) Appl. No.: 16/461,270

(22) PCT Filed: Nov. 8, 2017

(86) PCT No.: PCT/EP2017/078539
§ 371 (c)(1),
(2) Date: May 15, 2019

(87) PCT Pub. No.: WO2018/091322
PCT Pub. Date: May 24, 2018

(65) Prior Publication Data

US 2020/0156901 A1 May 21, 2020

(30) Foreign Application Priority Data

Nov. 21, 2016 (EP) ..... 16199788

(51) Int. Cl.
*B65H 75/44* (2006.01)

(52) U.S. Cl.
CPC ..... *B65H 75/4478* (2013.01); *B65H 75/4428* (2013.01); *B65H 75/4471* (2013.01); *B65H 2701/33* (2013.01); *B65H 2701/5122* (2013.01)

(58) Field of Classification Search
CPC ..... B65H 75/4428; B65H 75/4431; B65H 75/4471; B65H 75/4478
See application file for complete search history.

(56) References Cited

U.S. PATENT DOCUMENTS 2,629,630 A * 2/1953 Roark ..... B65H 75/4478
137/355.17
3,050,078 A * 8/1962 Hooper ..... B65H 75/38
137/355.19

(Continued)

FOREIGN PATENT DOCUMENTS

DE 8811047 U1 12/1989
DE 8910416 U1 1/1991

(Continued)

OTHER PUBLICATIONS

Pussemier, Bart, "International Search Report," prepared for PCT/EP2017/078539, dated Jan. 15, 2018, four pages.

*Primary Examiner* — Kevin F Murphy
(74) *Attorney, Agent, or Firm* — Lando & Anastasi, LLP

(57) ABSTRACT

A hose reel, for reeling up a hose for a fluid, is disclosed. The hose reel comprises a drum (100) for the hose to be reeled up on, the drum being moulded, the drum comprising, as integral moulded parts, a swivel connector (120) arranged at a central axis (110), the drum being rotatable about the central axis, a central flow path (130) coaxial with the central axis (110), and a radial flow path (140) extending radially from the central flow path; and a swivel (200) for a supply of the fluid, the swivel being connected to the swivel connector. A method for connecting a hose to the hose reel is disclosed. The method comprises the steps of: rotating the drum to align the connector (300) with the opening (410) of the housing (400); and connecting a hose to the connector, alternatively, before connecting the hose, releasing an already present hose.

15 Claims, 4 Drawing Sheets

(56) References Cited

U.S. PATENT DOCUMENTS

| | | | | |
|---|---|---|---|---|
| 5,758,685 | A * | 6/1998 | Tisbo | B65H 75/403 137/355.26 |
| 6,095,075 | A | 8/2000 | Gordon et al. | |
| 9,322,429 | B2 * | 4/2016 | Bauck | F16L 43/00 |
| 2012/0255627 | A1 * | 10/2012 | Arcati | B65H 75/4478 137/355.27 |
| 2014/0299133 | A1 * | 10/2014 | Neely | B65H 75/4478 128/205.25 |
| 2015/0122350 | A1 * | 5/2015 | Morgan | B65H 75/446 137/355.26 |

FOREIGN PATENT DOCUMENTS

| | | | |
|---|---|---|---|
| DE | 202004014200 | U1 | 11/2004 |
| FR | 2961706 | A1 | 12/2011 |
| GB | 2256632 | A | 12/1992 |
| JP | 3775842 | B2 | 5/2006 |

* cited by examiner

HOSE REEL AND METHOD FOR CONNECTING A HOSE TO THE HOSE REEL

CROSS-REFERENCE TO RELATED APPLICATIONS

This application is a U.S. National Stage Application under 35 U.S.C. § 371 of International Application No. PCT/EP2017/078539, filed Nov. 8, 2017, titled HOSE REEL AND METHOD FOR CONNECTING A HOSE TO THE HOSE REEL, which claims priority to European Application No. 16199788.7, filed Nov. 21, 2016. International Application No. PCT/EP2017/078539 is incorporated by reference herein in its entirety.

TECHNICAL FIELD

The present disclosure relates to hose reel. More particularly, the present disclosure relates to a hose reel for a fluid hose and a method for connecting a hose to such a hose reel.

BACKGROUND

Hose reels are used for reeling, winding, up a hose. Where a use of fluid, for example compressed air, is needed a hose supplying the fluid is reeled up so that the hose is stored and kept safe. The hose is reeled out as much as is needed and subsequently reeled up when stored away. Providing a specific area with a fluid hose in a usable and convenient way has always been a challenge.

Recently attention has been given to the amount of flow of the fluid that passes through the hose reel. The hose reel rotates but the fluid supply to the hose reel is stationary. This connection of fluid to the hose reel and the fluid flow through the hose reel reduces the flow of fluid. Recently attention has also been given to the fact that it is very cumbersome, if not impossible, to exchange or replace the hose reeled up on the hose reel. It is therefore desirable to overcome these problems and improve fluid flow through and the connectability to a hose reel.

It is also desirable to provide a hose reel that is inexpensive to manufacture, is easy to manufacture, and is robust. The hose reel must also be able to provide a good and reliable flow through the hose reel. The present disclosure is directed to overcoming one or more of the problems as set forth above.

SUMMARY OF THE INVENTION

It is an object of the present invention to provide a hose reel, for reeling up a hose for a fluid, and a method for connecting a hose to the hose reel. This object can be achieved by the features as defined by the independent claims. Further enhancements are characterised by the dependent claims.

According to one embodiment, a hose reel, for reeling up a hose for a fluid is disclosed. Fluid comprises liquid and gas. The hose reel comprises a drum for the hose to be reeled up on and a swivel for a supply of the fluid. The drum is moulded and comprises as integral moulded parts: a swivel connector arranged at a central axis, the drum being rotatable about the central axis, a central flow path coaxial with the central axis, and a radial flow path extending radially from the central flow path. The swivel is connected to the swivel connector.

According to one embodiment, the hose reel further comprises a connector 300 for connecting the radial flow path with the hose to be reeled up onto the hose reel. The connector may be form fitted into the drum, and the connector may be part of the drum and part of a fluid flow path through the drum.

According to one embodiment, the connector may comprise a first flow path and a second flow path, the first and second flow paths being connected at one end and forming an angle between each other in the range of 45 to 135 degrees. Preferably the angle is about 90 degrees.

According to one embodiment, the swivel and/or the connector comprise one of the following group: a U-shaped holder, a clamp, a quick fit coupling, and a nipple, for connecting the supply and/or the hose, respectively.

According to one embodiment, the hose reel further comprises a housing 400 for housing the drum, and the housing comprising an opening 410 to allow access to the connector.

According to one embodiment, the drum comprises a drum stop opening and the housing comprises a housing stop opening, the drum stop opening and the housing stop opening being arranged to align with each other in a position where the connector aligns with the opening of the housing.

According to one embodiment, the housing comprises a first part and a second part, the first part comprising an axle supporting the drum on the central axis, the second part comprising, means to hold the swivel.

According to one embodiment, the hose reel comprises a continuous flow path for the fluid formed by the swivel, the central flow path, the radial flow path, and the first and second flow paths of the connector together. According to one embodiment, continuous flow path for the fluid consists of the swivel, the central flow path, the radial flow path, and the first and second flow paths of the connector.

According to one embodiment, the drum comprises of a first drum part, a second drum part, and the connector, the connector being form fitted into one of the drum parts.

According to one embodiment, the connector is arranged completely within the drum.

According to one embodiment, a method for connecting a hose to the hose reel according to any one of the preceding embodiments is disclosed. The method comprises the steps of: rotating the drum to align the connector with the opening of the housing; and connecting a hose to the connector, alternatively, before connecting the hose, releasing an already present hose.

According to one embodiment, when connecting a hose to the hose reel according to any one embodiment that has stop openings, the method further comprises when rotating the drum to align the connector with the opening of the housing, aligning the drum stop opening with the housing stop opening. The method further comprises inserting an object (e.g. a screw driver, a stick, a peg, or similar) into the drum stop opening and the housing stop opening to lock the drum relative to the housing.

According to one embodiment, the method may further comprise connecting a hose from the supply of fluid to the swivel.

According to one embodiment, the method may further comprise attaching a hose to the swivel or the connector using one or more of a U-shaped holder, a clamp, a quick fit coupling, and a nipple.

One or more embodiments disclosed herein provide a hose reel with an uninterrupted flow of fluid through the hose reel. At least one embodiment provides a hose reel that is inexpensive to manufacture, is easy to manufacture, and is robust. At least one embodiment provides a method for exchanging or connecting a hose to the hose reel.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any claimed embodiment disclosed herein may be technically combined with any other claimed embodiment(s) disclosed herein.

BRIEF DESCRIPTION OF THE DRAWINGS

The accompanying drawings illustrate presently exemplary embodiments of the disclosure, and together with the general description given above and the detailed description of the embodiments given below, serve to explain, by way of example, the principles of the disclosure.

DETAILED DESCRIPTION

Figure 1:
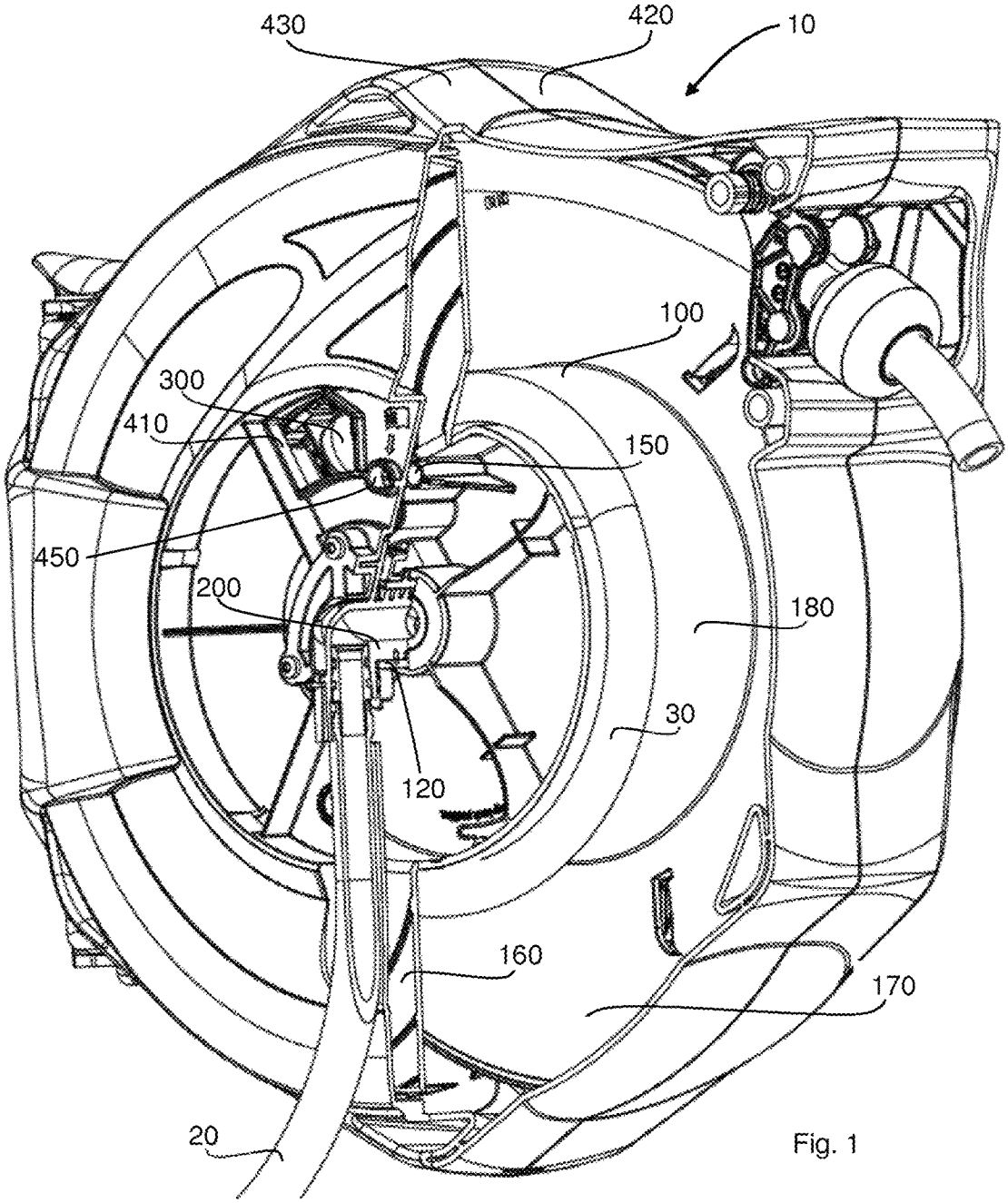
FIG. 1 is a diagrammatic illustration of a hose reel according to an exemplary embodiment of the present disclosure.
Figure 2:
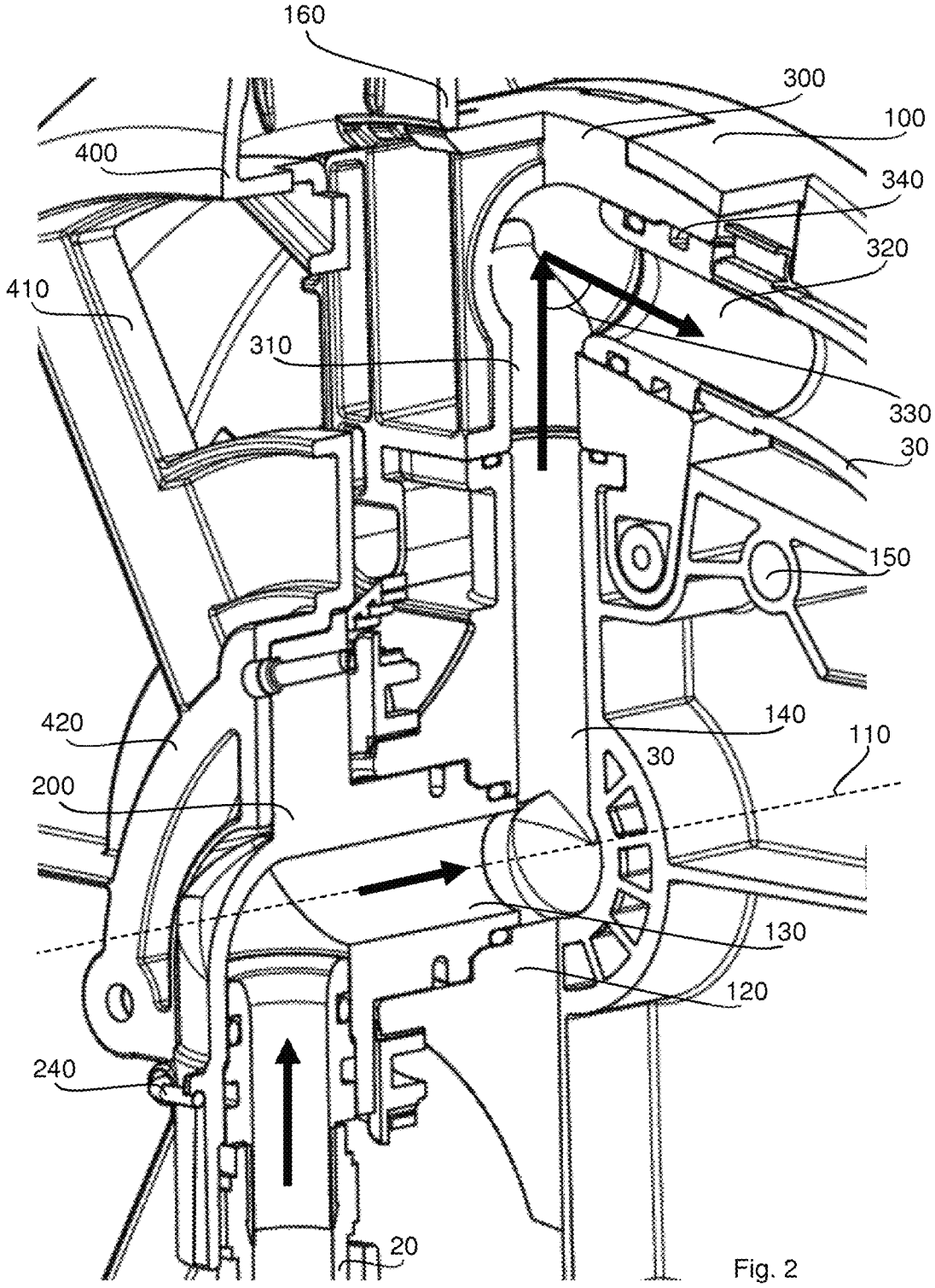
FIG. 2 is a diagrammatic illustration of details of a hose reel according to an exemplary embodiment of the present disclosure.
Figure 3:
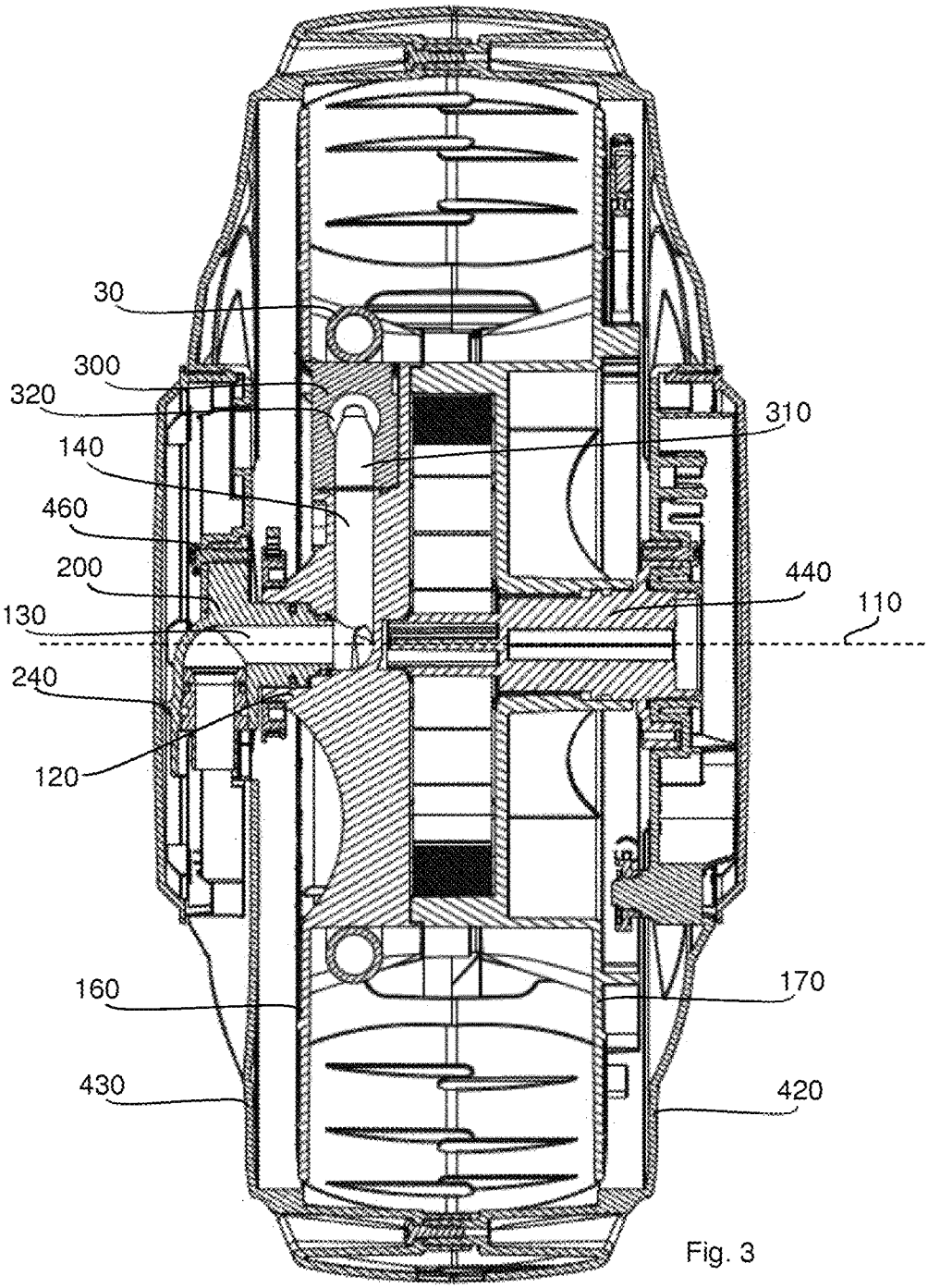
FIG. 3 is a diagrammatic illustration of a hose reel according to an exemplary embodiment of the present disclosure.

FIGS. 1-3 are diagrammatic illustrations of a hose reel according to an exemplary embodiment of the present disclosure. The hose reel 10 is for reeling up a hose 30 for a fluid. Fluid comprises liquid and gas, for example water, air, compressed air, fuel, etc. The hose reel comprises a drum 100 for the hose 30 to be reeled up on. The drum 100 may be rotatably arranged within a housing 400. The drum 100 is moulded, preferably injection moulded. The drum 100 is moulded as one part or as two or more parts. The drum 100 comprises, as integral moulded parts, moulded at the same time as the drum 100 is moulded, moulded in the same moulding process as the moulding process of the drum 100, a swivel connector 120, a central flow path 130, and a radial flow path 140. According to one embodiment, the drum 100, or a part of the drum 100, comprises, as integral moulded parts, the swivel connector 120, the central flow path 130, and the radial flow path 140, all these three being moulded in the same moulding process as the drum 100, or a part of the drum 100.

The swivel connector 120 is arranged at a central axis 110. The drum 100 is rotatable about the central axis 110, relative to the housing 400. The swivel connector 120 may be a part of the central axis 110. The central flow path 130 is coaxial with the central axis 110. The radial flow path 140 extends radially from the central flow path 130. The swivel connector 120, the central flow path 130, and the radial flow path 140 may be connected as a continuous flow path for the fluid within the drum 100. In this respect, see the black arrows in FIG. 2 illustrating the flow path through the hose reel.

The hose reel further comprises a swivel 200 for a supply of the fluid, the swivel 200 being connected to the swivel connector 120. The swivel 200 may be arranged to the swivel connector 120 for supplying fluid from a supply of fluid through the swivel to the swivel connector 120, the central flow path 130, and the radial flow path 140. The swivel 200 is a component that leads fluid from a stationary part to a rotating part. In this present exemplary embodiment, the swivel 200 is connected to a stationary fluid supply via the hose 20. In this exemplary embodiment, the swivel 200 is also connected to the stationary housing 400, for example housing part 430 with a screw 460. The swivel 200 is connected to the swivel connector 120 to provide fluid to the hose 30 reeled around the rotatable drum 100. The swivel 200 may thus be directly arranged/coupled to the drum 100. The fluid flow through the swivel 200 may be directly coupled to the central flow path 130 of the fluid flow through the drum 100.

According to one embodiment, the hose reel may further comprise a connector 300 for connecting the radial flow path 140 with the hose 30 to be reeled up onto the hose reel. The connector 300 may be a separate part of the drum 100, i.e. not an integral moulded part of the drum 100. The connector 300 may connect the fluid flow through the drum 100 with the hose 30 to be reeled up around the drum 100. The connector 300 may be part of a continuous flow path from the fluid supply to the hose 30 reeled up, that is from the fluid supply via the hose 20 to the swivel 200, to the swivel connector 120, to the central flow path 130, to the radial flow path 140, to the connector 300, to the hose 30 to be reeled up. According to one embodiment, the flow path through the hose reel consists of these; see the black arrows in FIG. 2 illustrating the flow path through the hose reel.

According to one embodiment, the connector 300 is form fitted into the drum 100. That is, the shape of the connector 300 fits into an opening of the drum 100, the shape and the opening be made for each other. In addition, for example, the connector 300 may be secured into the drum 100 by fastening means, such as a screw, a snap-fit, or similar. The connector 300 is part of the drum 100 and the connector 300 is also part of the fluid flow path through the drum 100. The flow path for the fluid through the drum 100 comprises, according to one embodiment consists of, the flow path through the swivel 200, the flow path through the swivel connector 120, the central flow path 130, the radial flow path 140, and the flow path through the connector 300.

According to one embodiment, the connector 300 comprises a first, preferably straight, flow path 310 and a second, preferably straight, flow path 320. The first flow path 310 and the second flow path 320 are connected at one end and they form an angle 330 between each other in the range of 45 to 135 degrees. This may best be taken from FIG. 2, where the flow through the first flow path 310 and the flow through the second flow path 320 are indicated by black arrows. According to one embodiment, the angle 330 is preferable 90 degrees, or about 90 degrees, or about 80 to 100 degrees, or 70 to 110 degrees. The other ends of the first flow path 310 and the second flow path 320 may be connected to the radial flow path 140 and to the hose 30 to be reeled up, respectively.

According to one embodiment, each of the swivel 200 and the connector 300 may comprise one of the following group: a U-shaped holder 240, 340, a clamp, a quick fit coupling, and a nipple, for connecting the supply and/or the hose, respectively. Connecting to the supply is preferably done by using a hose 20 that is connected to the swivel 200. The nipple may be a nipple for a coupling, such as a quick fit coupling. The U-shaped holder 240, 340 holds the end of the hose 20, 30 with the middle part of its two legs, while the top and bottom of the U-shaped holder is secured in the drum 100, or swivel 200, or connector 300, respectively. In this way a hose 20, 30 may be secured to the hose reel 10. In this way the swivel 200 may be connected to the swivel connector 120.

According to one embodiment, the hose reel 10 further comprises a housing 400 for housing the drum 100. The housing 400 comprises an opening 410 to allow access to the connector 300. The connector 300 in the drum 100 may be accessed by a user through the opening 410 in the housing 400 to connect or disconnect a hose 30. In this way the housing 400 must not be dismantled from the drum 100 when a hose 30 is serviced or connected.

According to one embodiment, the drum 100 comprises a drum stop opening 150 and the housing 400 comprises a housing stop opening 450. This is best illustrated in FIG. 1. The drum stop opening 150 and the housing stop opening 450 are arranged to align with each other in a position where the connector 300 aligns with the opening 410 of the housing 400. By rotating the drum 100 relative to the housing 400, the two stop openings 150, 450 are aligned. Subsequently, an object may be inserted into both stop openings 150, 450, such as for example a screw driver. Hereby the drum 100 is locked in position relative to the housing 400 in a position where a user can access the connector 300 through the opening 410 of the housing 400. These stop openings 150, 450 makes it easy to access the connector 300, because the drum 100 may be spring loaded to rewind the hose. When accessing the connector 300 the stop openings 150, 450 assure that the hose reel suddenly does not rotate the drum 100.

According to one embodiment, the housing 400 comprises a first part 420 and a second part 430. The first part 420 and the second part 430 are housing parts. The first part 420 comprises an axle 440 supporting the drum 100 on the central axis 110. This may best be taken from FIG. 3. The second part 430 comprising means 460 to hold the swivel 200. The axle 440 may be a support 440. In this way the housing 400 supports the relative rotation of the drum 100 within the housing 400 around the central axis. The first part 420 may be half the housing 400 and the second part 430 may be the other half of the housing 400.

According to one embodiment, the flow path through the swivel 200, the central flow path 130, the radial flow path 140, and the first and second flow paths 310, 320 of the connector 300 together form a continuous flow path for the fluid, through the drum 100. The continuous flow path is illustrated as black arrows in FIG. 2. The continuous flow path may be an uninterrupted, open, flow path for the fluid. The continuous flow path may be absent of any mechanism in the fluid flow used to connect or create the continuous flow path, absent of any reductions in size. That is, the continuous flow path is absent of any sudden changes of its formation, the continuous flow path has a continuous form, shape, or opening. The flow path through the hose reel, through the drum, has a, more or less, constant diameter. That is, a perpendicular cut through the flow path, anywhere along the flow path, is always disk shaped, with a perpendicular cut through the turns of the flow path naturally being somewhat oval shaped. In this way the fluid flows through the hose reel with a minimal resistance. The continuous flow path may start at the swivel 200 and may end with the connector 300. The continuous flow path is part of the fluid flow from the fluid supply, and the hose 20 connected to the swivel 200, to the hose 30 to be reeled up, connected to the connector 300. According to one embodiment, the continuous flow path consist out of the flow path through the swivel 200, the central flow path 130, the radial flow path 140, and the first and second flow paths 310, 320 of the connector 300.

According to one embodiment, the drum 100 comprises of a first drum part 160, a second drum part 170, and the connector 300. The connector 300 may be form fitted into one of the drum parts 160, 170. The drum 100 may have one or more drum parts. All or some drum parts may be moulded.

According to one embodiment, the connector 300 is arranged completely within the drum 100. The connector 300 may be form fitted completely within the drum 100, i.e. not protruding beyond the drum 100 in the radial direction. The connector 300 may be flush with a bottom 180 of the drum 100. The drum bottom 180 is the bottom 180 upon which the hose 30 is to be reeled up around. As the connector 300 is within the drum 100 no obstruction exist for reeling up the hose 30, and access to the connector 300 can be arranged by the opening 410 of the housing 400. The connector 300 may be connected to the radial flow path 140 of the drum 100. For example one of the connector 300 or the radial flow path 140 may be T-shaped and the other part may be complimentary shaped so that they can connect. An o-ring, or similar, may be used to ensure no leakage of fluid between the connector 300 and the radial flow path 140.

Figure 4:
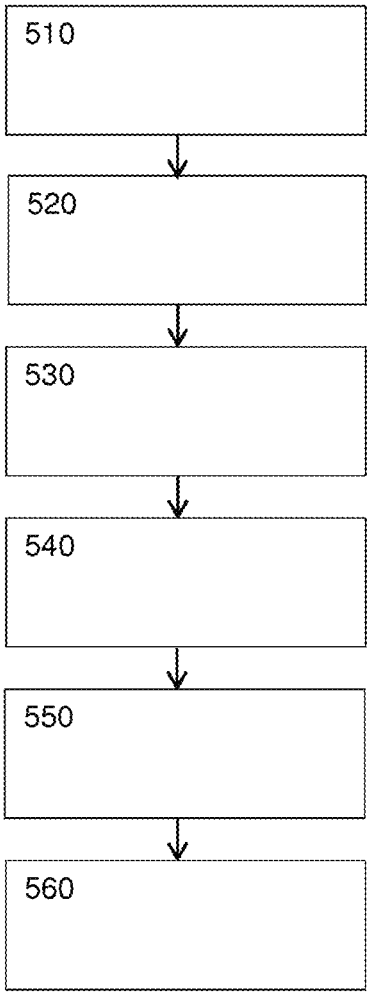
FIG. 4 is a diagrammatic illustration of a method for connecting a hose to the hose reel according to an exemplary embodiment of the present disclosure.

Turning to the method, FIG. 4 is a diagrammatic illustration of the method for connecting a hose to the hose reel according to an exemplary embodiment of the present disclosure. The first two method steps 510 and 520 are taken in order, and the other method steps 530, 540, 550, and 560, may be taken in any order, even before, after, or between the first two method steps, as long as it makes technical sense. The method as illustrated in FIG. 4 comprises: 510 a first method step, rotating the drum 100 relative to the housing 400; 520 a second method step, connecting a hose 30 to the connector 300; 530 a method step of aligning the two stop openings 140, 440; 540 a method step of inserting an object, for example a screw driver, into the two stop openings; 550 a method step of connecting a hose 20 to the swivel 200; and 560 a method step of attaching a hose to the hose reel. The steps 530 and 540 are normally taken between steps 510 and 520. The step 550 may be taken any time and step 560 is taken normally last. The method steps are explained in more detail below.

According to one exemplary embodiment, a method for connecting a hose 30 to the hose reel 10 according to any one of the embodiments disclosed herein is disclosed. The method comprises the following to steps in order: rotating 510 the drum 100 to align the connector 300 with the opening 410 of the housing 400; and connecting 520 a hose 30 to the connector 300, alternatively, before connecting the hose 30, releasing an already present hose 30. The rotation 510 of the drum 100 is a rotation relative to the housings 400. In this way a user may access the connector 300 through the opening 410 of the housing 400 and change, disconnect or connect, a hose 30 to the connector 300, i.e. to the drum 100.

According to one embodiment, when connecting a hose 30 to the hose reel according to any embodiment disclosed herein, the method further comprises the following. When rotating 510 the drum 100 to align the connector 300 with the opening 410 of the housing 400, then also aligning 530 the drum stop opening 150 with the housing stop opening 450. Inserting 540 an object, for example a screw driver, stick, peg, etc., into the drum stop opening 150 and the housing stop opening 450 to lock the drum 100 relative to the housing 400. By additional aligning the drum stop opening 150 with the housing stop opening 450 the drum 100 can be simply (without technical complicated means) and effectively locked relative to the housing 400. This has as a technical effect that the two are locked and that a spring loaded drum 100 is held still while the object is inserted. This in turn allows for a hose to be connected to the connector 300.

According to one embodiment, the method may further comprise connecting 550 a hose 20 from a supply of fluid to the swivel 200. A hose 20 may connect the fluid supply with the hose reel. Connection to the hose 20 to the swivel 200 may be done using a U-shaped holder 240.

According to one embodiment, the method may further comprise attaching 560 a hose 20, 30 to the swivel 200 or the connector 300 using one or more of a U-shaped holder 240, 340, a clamp, a quick fit coupling, and a nipple. In this way a hose can be easily connected to the hose reel. The U-shaped holder allows attaching a hose to the hose reel with very little mechanical means and very little space for the attachment. The U-shaped holder may also be easily inserted and withdrawn from the limited space within the hose reel, for example through the opening 410 of the housing 400.

According to at least one embodiment disclosed herein, a hose reel is provided with an uninterrupted flow of fluid through the hose reel. At least one embodiment provides a hose reel that is inexpensive to manufacture, is easy to manufacture, and is robust. At least one embodiment provides a method for exchanging or connecting a hose to the hose reel. The construction of the drum and its relation to the housing gives a manufacturing process resulting in high and easy controllable quality of the hose reel.

It will be apparent to those skilled in the art that various modifications and variations can be made to the hose reel and the method for connecting a hose to the hose reel. Other embodiments will be apparent to those skilled in the art from consideration of the specification and practice of the disclosed hose reel. It is intended that the specification and examples be considered as exemplary only, with a true scope being indicated by the following claims and their equivalents.

LIST OF ELEMENTS FOR THE HOSE REEL

10 hose reel
20 hose from supply to hose reel
30 hose reeled up on hose reel
100 drum
110 central axis
120 swivel connector
130 central flow path
140 radial flow path
150 drum stop opening
160 first drum part
170 second drum part
180 bottom (of the drum)
200 swivel
240 clamp (for clamping hose to swivel)
300 connector
310 first flow path
320 second flow path
330 angle
340 clamp (for clamping hose to connector)
400 housing
410 opening
420 first part of housing
430 second part of housing
440 axle of housing
450 housing stop opening
460 means holding swivel
510 first method step, rotating
520 second method step, connecting to connector
530 aligning method step
540 inserting method step
550 connecting to swivel method step
560 attaching method step

The invention claimed is:

1. A hose reel for reeling up a hose for a fluid, the hose reel comprising:

a drum for the hose to be reeled up on, the drum being molded, the drum comprising, as integral molded parts molded at the same time as the drum is molded, molded in the same molding process as the molding process of the drum:

a molded swivel connector arranged at a central axis, the drum being rotatable about the central axis;

a molded central flow path coaxial with the central axis;

a molded radial flow path extending radially from the central flow path; and a swivel for connecting a supply hose for a supply of the fluid, the swivel being connected directly to the molded swivel connector; and a connector for connecting the radial flow path with the hose to be reeled up onto the hose reel, wherein the connector is form fitted into the drum and the connector is part of the drum and part of a fluid flow path through the drum, the connector not protruding beyond a bottom of the drum, the bottom being the bottom upon which the hose is to be reeled up around.

2. The hose reel according to claim 1, wherein the connector comprises a first flow path and a second flow path, the first and second flow paths being connected at one end and forming an angle between each other in the range of 45 to 135 degrees.

3. The hose reel according to claim 2, wherein the swivel, the central flow path, the radial flow path, and the first and second flow paths of the connector together form a continuous flow path for the fluid.

4. The hose reel according to claim 1, wherein at least one of the swivel and the connector comprise one of the following group:

a U-shaped holder;

a clamp;

a quick fit coupling; and a nipple;

for connecting at least one of the supply and the hose, respectively.

5. The hose reel according to claim 1, wherein the hose reel further comprises a housing for housing the drum, and the housing comprises an opening to allow access to the connector.

6. The hose reel according to claim 5, wherein the drum comprises a drum stop opening and the housing comprises a housing stop opening, the drum stop opening and the housing stop opening being arranged to align with each other in a position where the connector aligns with the opening of the housing.

7. The hose reel according to claim 5, wherein the housing comprises a first part and a second part, the first part comprising an axle supporting the drum on the central axis, the second part comprising means to hold the swivel.

8. The hose reel according to claim 1, wherein the drum comprises a first drum part, a second drum part, and the connector, the connector being form fitted into one of the drum parts.

9. The hose reel according to claim 1, wherein the swivel connector is arranged within the drum.

10. A method for connecting a hose to a hose reel for reeling up a hose for a fluid, the hose reel comprising:

a drum for the hose to be reeled up on, the drum being molded, the drum comprising, as integral molded parts, molded at the same time as the drum is molded, molded in the same molding process as the molding process of the drum:

a molded swivel connector arranged at a central axis, the drum being rotatable about the central axis;

a molded central flow path coaxial with the central axis; and a molded radial flow path extending radially from the central flow path;

a swivel for connecting a supply hose for a supply of the fluid, the swivel being connected directly to the molded swivel connector;

a connector for connecting the radial flow path with the hose to be reeled up onto the hose reel, wherein the connector is form fitted into the drum and the connector is part of the drum and part of a fluid flow path through the drum, the connector not protruding beyond a bottom of the drum, the bottom being the bottom upon which the hose is to be reeled up around; and a housing for housing the drum, and the housing comprises an opening to allow access to the connector;

the method comprising:

rotating the drum to align the connector with the opening of the housing; and connecting a hose to the connector; or before connecting the hose, releasing an already present hose before connecting the hose.

11. The method according to claim 10, wherein the drum comprises a drum stop opening and the housing comprises a housing stop opening, the drum stop opening and the housing stop opening being arranged to align with each other in a position where the connector aligns with the opening of the housing; and the method further comprising:

when rotating the drum to align the connector with the opening of the housing, aligning the drum stop opening with the housing stop opening; and inserting an object into the drum stop opening and the housing stop opening to lock the drum relative to the housing.

12. The method according to claim 10, wherein the housing comprises a first part and a second part, the first part comprising an axle supporting the drum on the central axis, the second part comprising means to hold the swivel; and the method further comprising:

when rotating the drum about the axle of the first part to align the connector with the opening of the housing, aligning a drum stop opening of the drum with a housing stop opening of the second part; and inserting an object into the drum stop opening and the housing stop opening to lock the drum relative to the housing.

13. The method according to claim 10, wherein the connector comprises a first flow path and a second flow path, the first and second flow paths being connected at one end and forming an angle between each other in the range of 45 to 135 degrees;

wherein the swivel, the central flow path, the radial flow path, and the first and second flow paths of the connector together form a continuous flow path for the fluid; and the method further comprising:

when rotating the drum to align the connector with the opening of the housing, the continuous flow path for the fluid remains uninterrupted.

14. The method according to claim 10, wherein the drum comprises a first drum part, a second drum part, and the connector, the connector being form fitted into one of the drum parts; and the method further comprising:

when rotating the drum to align the connector with the opening of the housing, aligning a drum stop opening in the one of the drum parts with a housing stop opening; and inserting an object into the drum stop opening and the housing stop opening to lock the drum relative to the housing.

15. The method according to claim 10, wherein the connector is arranged completely within the drum; and the method further comprising:

when rotating the drum to align the connector with the opening of the housing, aligning a drum stop opening with a housing stop opening; and inserting an object into the drum stop opening and the housing stop opening to lock the drum relative to the housing.

* * * * *